US007549413B1

(12) United States Patent
Sharpton

(10) Patent No.: US 7,549,413 B1
(45) Date of Patent: Jun. 23, 2009

(54) FLAME PROTECTION GASKET

(75) Inventor: A. Dewayne Sharpton, Stillwater, OK (US)

(73) Assignee: Brunswick Corporation, Lake Forest, IL (US)

( * ) Notice: Subject to any disclaimer, the term of this patent is extended or adjusted under 35 U.S.C. 154(b) by 21 days.

(21) Appl. No.: 11/804,568

(22) Filed: May 18, 2007

(51) Int. Cl.
*F02M 29/04* (2006.01)

(52) U.S. Cl. ..... 123/593; 277/599; 48/189.6

(58) Field of Classification Search ..... 123/339.1, 123/593, 198 D; 277/313, 591, 592; 48/189.6
See application file for complete search history.

(56) References Cited

U.S. PATENT DOCUMENTS

| | | | | | |
|---|---|---|---|---|---|
| 1,404,652 | A | * | 1/1922 | Rohnow | 48/189.6 |
| 1,415,656 | A | * | 5/1922 | Kunz | 219/551 |
| 1,422,916 | A | * | 7/1922 | Betts | 48/189.6 |
| 4,020,812 | A | * | 5/1977 | Hayward | 123/549 |
| 4,094,290 | A | * | 6/1978 | Dismuke | 48/189.6 |
| 4,121,543 | A | * | 10/1978 | Hicks et al. | 123/3 |
| 4,163,436 | A | * | 8/1979 | Fugett | 123/592 |
| 4,268,289 | A | | 5/1981 | Polaner | 55/486 |
| 4,628,890 | A | * | 12/1986 | Freeman | 123/593 |
| 4,893,591 | A | | 1/1990 | Nelson | 123/52 MF |
| 5,310,198 | A | * | 5/1994 | Belter | 277/599 |
| 5,323,753 | A | * | 6/1994 | Cikanek et al. | 123/593 |
| 5,357,913 | A | | 10/1994 | Okumura et al. | 123/184.34 |
| 5,437,258 | A | * | 8/1995 | Williams et al. | 123/593 |
| 5,709,187 | A | | 1/1998 | Jaeger et al. | 123/198 D |
| 5,937,838 | A | * | 8/1999 | Harrell | 123/593 |
| 6,098,401 | A | | 8/2000 | Alassoeur et al. | 60/261 |
| 6,705,267 | B1 | | 3/2004 | Westerbeke et al. | 123/184.53 |
| 6,834,637 | B1 | | 12/2004 | Sharpton | 123/339.1 |
| 7,077,113 | B2 | | 7/2006 | Bilek et al. | 123/563 |
| 7,137,378 | B1 | | 11/2006 | Jaeger et al. | 123/198 D |
| 2008/0223349 | A1 | * | 9/2008 | Uenomaya et al. | 123/65 V |

* cited by examiner

*Primary Examiner*—Erick Solis
(74) *Attorney, Agent, or Firm*—William D. Lanyi

(57) ABSTRACT

A flame protection gasket has a gasket member with an embedded screen member within its structure. The screen member and gasket member are disposed in a common plane. The screen member is attachable to an air conduit structure in a manner that inhibits its removal after the attachment is completed. In addition, since the gasket member and screen member are part of an integral structure, the screen member must be replaced if the gasket member is replaced following repair or reassembly.

4 Claims, 3 Drawing Sheets

FLAME PROTECTION GASKET

BACKGROUND OF THE INVENTION

1. Field of the Invention

The present invention is generally related to a flame protection component and, more particularly, to a gasket which has a flame protection screen formed as an integral part of the gasket structure.

2. Description of the Related Art

It is well known to those skilled in the art that a perforated metal plane, such as a screen, can be used as a flame arresting structure when placed over a conduit within which flammable gases can exist. The perforated surface inhibits the progression of a flame front within the gas containing structure.

U.S. Pat. No. 4,268,289, which issued to Polaner on May 19, 1981, describes a flame arresting air filter element. It has an outer ring of pleated filtering paper and an inner, concentric ring formed of expanded metal foil, longitudinally stretched and laterally compressed so as to be adapted to diffuse and quench flames resulting from engine backfire.

U.S. Pat. No. 4,893,591, which issued to Nelson on Jan. 16, 1990, describes a manifold flame arrestor. The system is intended for use with an internal combustion engine having a plurality of cylinders. It serves to reduce the possibility of transmission of combustion producing flame from a cylinder into the intake manifold of an engine.

U.S. Pat. No. 5,357,913, which issued to Okumura et al. on Oct. 25, 1994, describes a flame arrester arrangement for a marine propulsion engine. The flame arrester is positioned vertically above the thermostat housing at one end of the engine and the plenum chamber for the intake manifold is disposed above the exhaust elbow of the engine so as to provide good induction efficiency and compact size.

U.S. Pat. No. 5,709,187, which issued to Jaeger et al. on Jan. 20, 1998, discloses a flame arrestor for a marine engine which includes an air box mounted to the combustion air intake and a uniplanar flame arresting element mounted to the air box and passing combustion air therethrough in a first direction into the air intake and blocking flame propagation in a second opposite direction out of the air intake. Air flow from the flame arresting element to the air intake is rectilinear.

U.S. Pat. No. 6,098,401, which issued to Alassoeur et al. on Aug. 8, 2000, describes an after burner flame holder with rotationally splitting radial arms. The device is intended for a turbo jet engine. The arms consist of a fixed rear part and a front part which is separable from the rear part in a circumferential direction along a median joint plane.

U.S. Pat. No. 6,705,267, which issued to Westerbeke et al. on Mar. 16, 2004, describes combustion engines. A safety feature includes an intake silencer defining an internal volume sized to help attenuate air pressure fluctuations generated within the carburetor and engine and transmitted back through the entering combustion air. It also functions as a flame arrester.

U.S. Pat. No. 6,834,637, which issued to Sharpton on Dec. 28, 2004, discloses an adapter for an idle air control valve. It has a rigid tubular member extending between a distal insertion end and an attachment pedestal end. The insertion member, or distal end, is rigidly attached to an air passage of the throttle body and an idle air control valve is rigidly attached to the attachment end. This allows an idle air control valve to be rigidly mounted to a throttle body while being displaced from the throttle body and held in a non-contact association with the throttle body to allow different variations and styles of idle air control valves to be used with various types of throttle bodies.

U.S. Pat. No. 7,077,113, which issued to Bilek et al. on Jul. 18, 2006, describes a combined intercooler and flame arrester. The intercooler comprises an elongated body having a longitudinal axis. The elongated body has a central passageway that extends substantially parallel to the longitudinal axis. An inlet opening is located on one end of the elongated body such that the intake gas enters the central passageway through the inlet body.

U.S. Pat. No. 7,137,378, which issued to Jaeger et al. on Nov. 21, 2006, discloses a component mounting system for a marine engine. An attachment and support system is provided for supporting a flame arrestor and cover at a preselected position relative to a throttle body which, in turn, is attached to an air intake manifold. A support member is attached, by four bolts, to the air intake manifold. The four bolts, or alternative attachment components, simultaneously attach the throttle body to the air intake manifold and the support member to the throttle body. Both the flame arrestor and cover are attached, by a stud, to the support member.

The patents described above are hereby expressly incorporated by reference in the description of the present invention.

In view of Coast Guard regulations requiring flame arresters to be, in essence, tamper proof, it would be significantly beneficial if a flame arrester, or flame retarding element, could be provided which remains in place after service operations are completed or after components are replaced. It would be beneficial if a flame prevention component could be provided which cannot easily be removed or omitted during reassembly following the servicing of the associated internal combustion engine.

SUMMARY OF THE INVENTION

A flame protection gasket made in accordance with a preferred embodiment of the present invention comprises a screen member and a gasket member. A portion of the screen member is imbedded within the gasket member structure.

In a preferred embodiment of the present invention, the screen member and the gasket member are in a common central plane. The gasket member comprises first and second contact surfaces which are parallel to each other. The screen member is disposed between the first and second contact surfaces in a preferred embodiment of the present invention. The first contact surface can be disposed in contact with a surface of an air intake member. The gasket member can be attached to the air intake member and the screen member can be attached to the surface of the air intake member. The screen member, in a preferred embodiment of the present invention, can be nonremovably attachable to the surface of the air intake member. For example, the screen member can be riveted to the surface of the air intake member. The air intake member can be a support structure for an idle air control valve.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
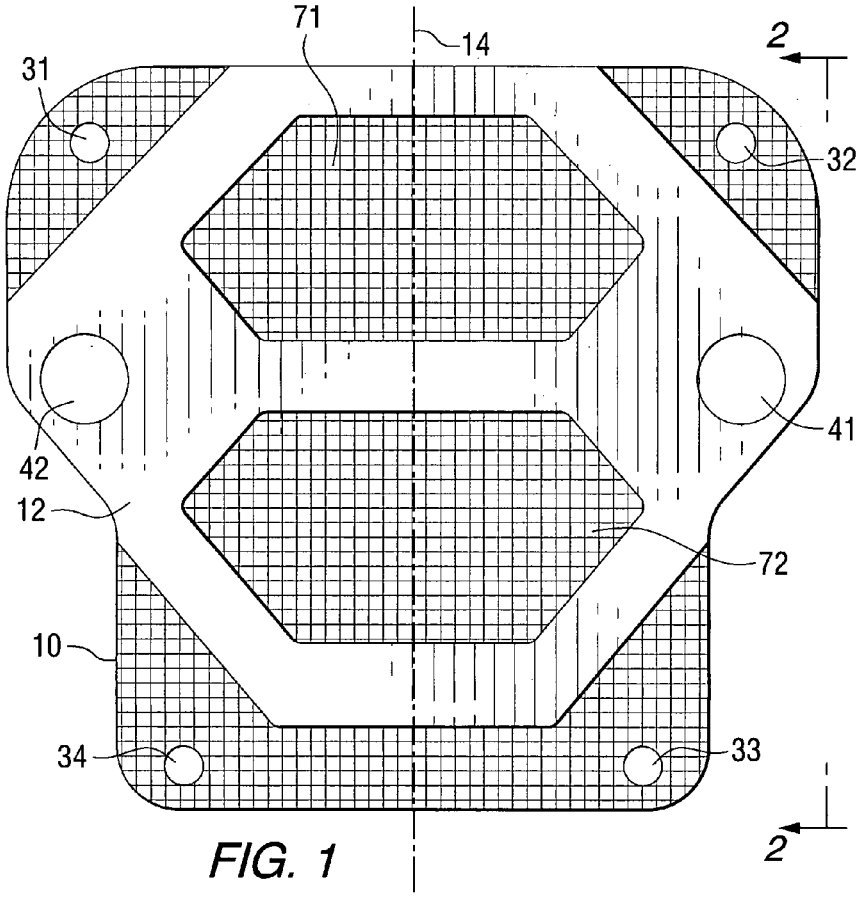
FIG. 1 shows the flame protection gasket of a preferred embodiment of the present invention.

Throughout the description of the preferred embodiment of the present invention, like components will be identified by like reference numerals.

FIG. 1 shows a flame protection gasket made in accordance with a preferred embodiment of the present invention. It comprises a screen member 10 and a gasket member 12. A portion of the screen member is embedded within the gasket member.

Figure 2:
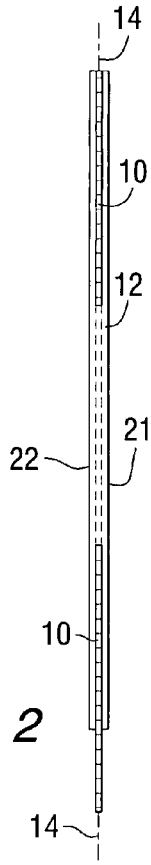
FIG. 2 is a side view of the structure shown in FIG. 1.

FIG. 2 is a side view of the structure shown in FIG. 1. With reference to FIGS. 1 and 2, it can be seen that the screen member 10 and the gasket member 12 are both in a common plane 14 which is illustrated in FIG. 2. The gasket member 12 has a first contact surface 21 and a second contact surface 22. The first and second contact surfaces, 21 and 22, are parallel to each other as shown in FIG. 2. The screen member 10 is disposed between the first and second contact surfaces, 21 and 22, as shown in FIG. 2.

With continued reference to FIGS. 1 and 2, it can be seen that the screen member 10 is provided with four holes, 31-34, which allow the screen member 10 to be rigidly and permanently attached to a surface of an air conduit structure which will be described in greater detail below. In addition, it can be seen that two holes, 41 and 42, are provided through the gasket member 12. These holes allow the gasket member 12 to be aligned with and attached to the air intake member which will be described in greater detail below.

Figure 3:
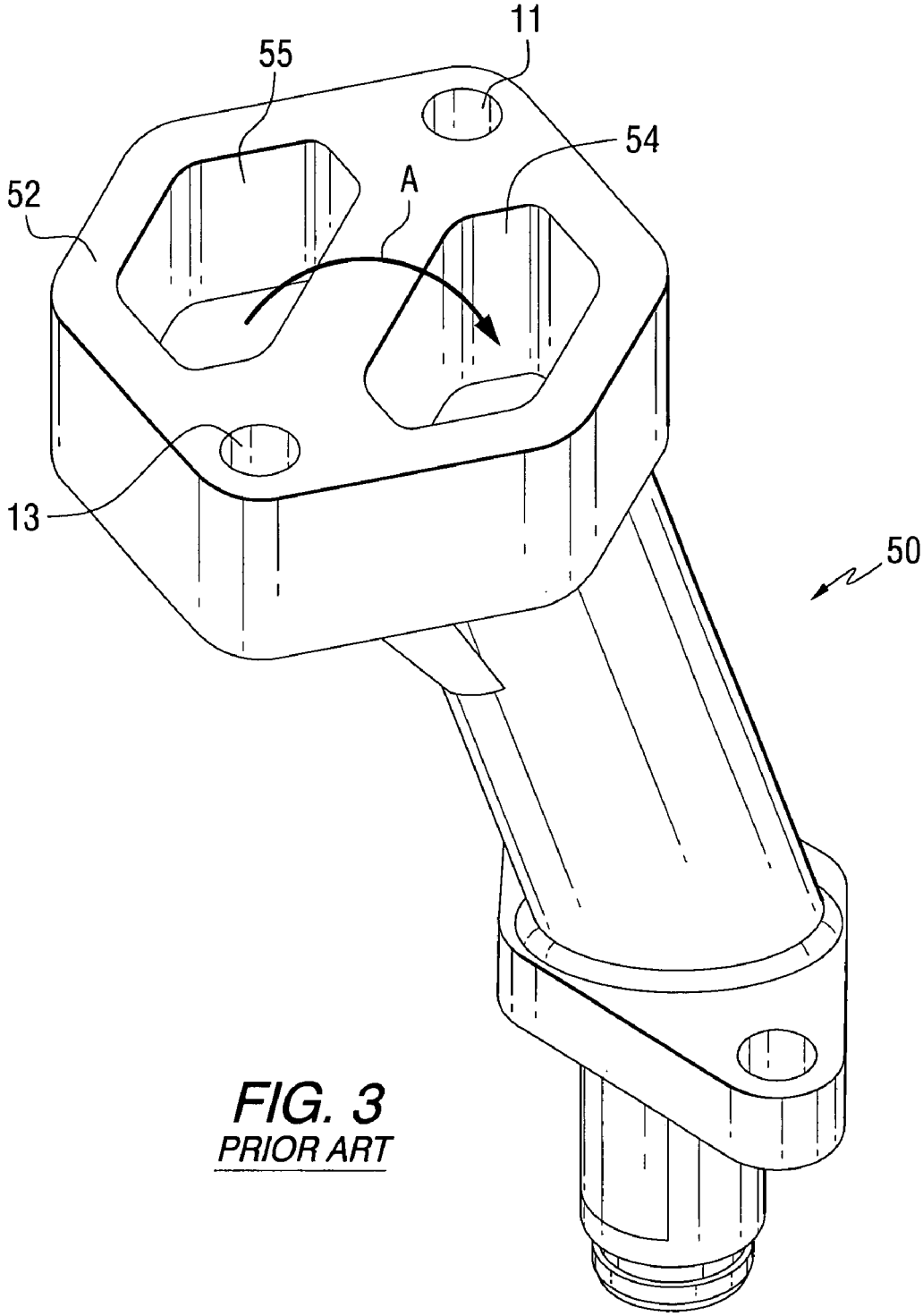
FIG. 3 PRIOR ART
FIG. 3 shows a prior art support structure for an idle air relief valve.

FIG. 3 shows a known type of valve adapter 50 which is generally similar to the valve adapter described in U.S. Pat. No. 6,834,637 which is discussed above. It has a mounting surface 52 and openings, 54 and 55, which are described in detail in U.S. Pat. No. 6,834,637. The basic function and structure of the adapter 50 is described in detail in U.S. Pat. No. 6,834,637 and, although the specific shape of the adapter which will be described below is slightly different, the basic function and purpose of the adapter is the same. The flame protection gasket of the present invention is intended to be attached to the surface 52 through which the openings, 54 and 55, are formed.

Figure 4:
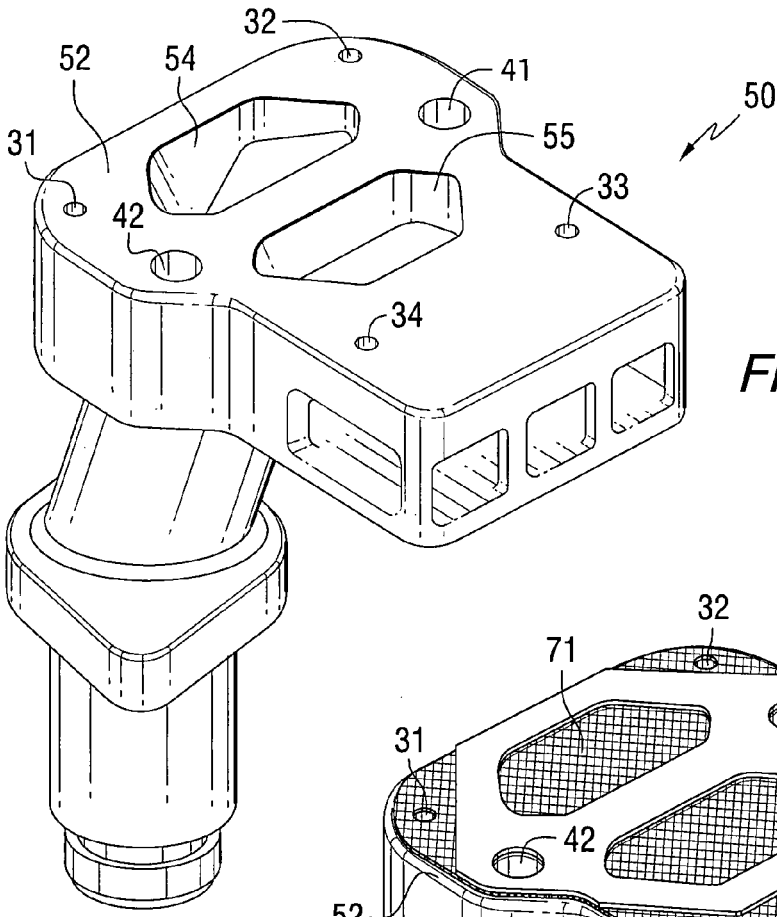
FIG. 4 shows a slightly modified version of the support structure of FIG. 3.

FIG. 4 shows a slightly modified form of the adapter 50 described above in conjunction with FIG. 3 and described in greater detail in U.S. Pat. No. 6,834,637. However, it should be understood that the basic function of the adapter 50 shown in FIG. 4 remains unchanged. Its purpose is to provide an adapter which supports an idle air control valve which is disposed on surface 52.

Figure 5:
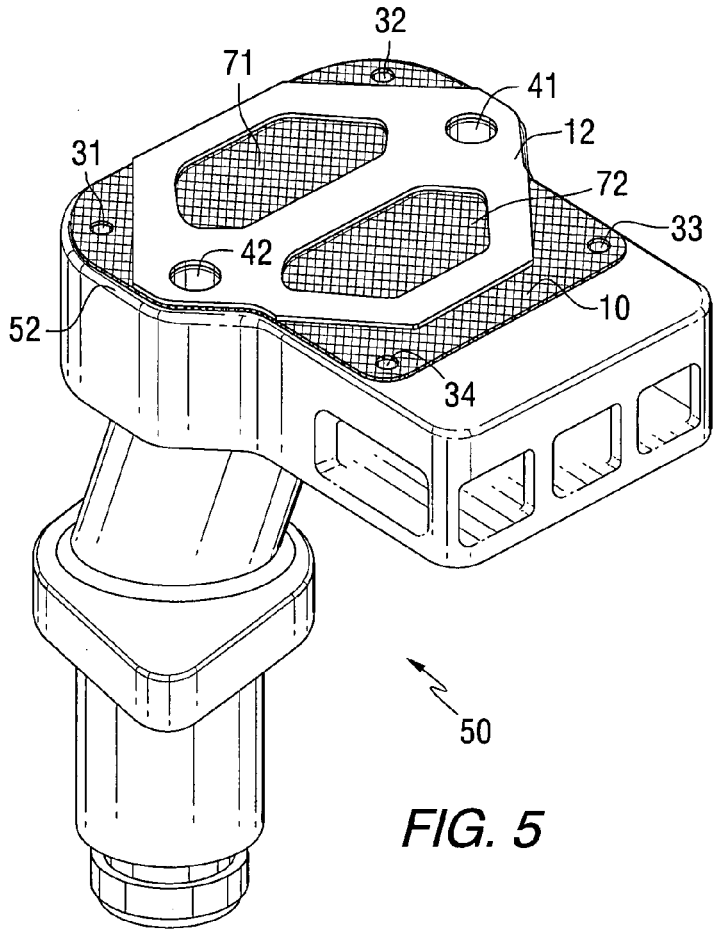
FIG. 5 shows the structure of FIG. 4 with the flame protection gasket attached to an upper surface

FIG. 5 shows the adapter 50, which is described in conjunction with FIG. 4, with the flame protection gasket of the present invention attached to its upper surface 52. With reference to FIGS. 1, 4, and 5, it can be seen that the gasket member 12 is at a location where its two openings, 71 and 72, are aligned with the two openings, 54 and 55, of the adapter 50. The two holes, 41 and 42, in the flame protection gasket allow it to be rigidly attached between the upper surface 52 of the adapter 50 and an idle air control valve (not shown in the Figures) which is placed above surface 52 with the flame protection gasket therebetween. The four holes, 31-34, that are formed through the screen member 10, allow it to be rigidly and permanently attached to the upper surface 52. In a preferred embodiment of the present invention, this is done through the use of four rivets. The structure of the flame protection gasket is a combination of both the screen member 10 and the gasket member 12 which each perform specific and unique functions, but the combination provides additional advantages. The fact that the screen member 10 is embedded as an integral part of the gasket member 12, as described above and illustrated in FIG. 2, assures that screen member 10 is not omitted when the idle air control valve is removed from the surface 2 of the adapter 5 and then replaced. The rivets through holes 31-34 inhibit the removal of either the screen member 10 or the gasket member 12. In the unlikely event that this permanent attachment is defeated, reassembly without the screen member 10 would also omit the gasket member 12. Therefore, the preferred embodiment of the present invention assures that the flame arrester characteristic of the gasket and screen combination structure is not defeated during repair or reassembly.

With reference to FIGS. 1, 2, 4, and 5, it can be seen that the flame protection gasket in a preferred embodiment of the present invention comprises a screen member 10 and a gasket member 12 wherein a portion of the screen member 10 is embedded within the gasket member 12. The screen member 10 and the gasket member 12 are disposed in a common central plane 14. The gasket member 12 comprises first and second contact surfaces, 21 and 22, which are parallel to each other as shown in FIG. 2. The screen member is disposed between the first and second contact surfaces. The first contact surface 21 is disposable in contact with a surface 52 of an air intake member which, as described above, can be an adapter 50. The gasket member 12 is attachable to the air intake member 50 and the screen member 10 is attachable to the surface 52 of the air intake member. The screen member 10 is nonremovably attached, such as by rivets through holes 31-34, to the surface 52 of the air intake member 50. The air intake member 50 can be a support structure for an idle air control valve (not shown in the figures).

Although the present invention has been shown with particular specificity and illustrated to show a preferred embodiment, it should be understood that alternative embodiments are also within its scope.

I claim:

1. A flame protection gasket, comprising:

a screen member; and a gasket member, a portion of said screen member being embedded within said gasket member, wherein:

said gasket member comprises first and second contact surfaces which are parallel to each other, said screen member being disposed between said first and second contact surfaces;

said first contact surface is disposable in contact with a surface of an air intake member, said gasket member being attachable to said air intake member, said screen member being attachable to said surface of said air intake member;

said air intake member is a support structure for an idle air control valve.

2. A flame protection gasket, comprising:

a screen member; and a gasket member, said gasket member comprising first and second contact surfaces which are parallel to each other, a portion of said screen member being embedded within said gasket member, said screen member being disposed between said first and second contact surfaces, wherein:

said first contact surface is disposable in contact with a surface of an air intake member, said gasket member being attachable to said air intake member, said screen member being attachable to said surface of said air intake member;

said screen member is nonremovably attachable to said surface of said air intake member;

said screen member is riveted to said surface of said air intake member;

said air intake member is a support structure for an idle air control valve.

3. A flame protection gasket, comprising:

a screen member; and a gasket member, said gasket member comprising first and second contact surfaces which are parallel to each other, a portion of said screen member being embedded within said gasket member, said screen member being disposed between said first and second contact surfaces, said first contact surface being disposable in contact with a surface of an air intake member, said gasket member being attachable to said air intake member, said screen member being attachable to said surface of said air intake member, said screen member being nonremovably attachable to said surface of said air intake member, wherein:

said screen member is riveted to said surface of said air intake member;

said air intake member is a support structure for an idle air control valve.

4. A flame protection gasket comprising:

a screen member;

a gasket member, a portion of said screen member being embedded within said gasket member, wherein:

said screen member and said gasket member lie in a common plane;

said gasket member has an outer perimeter lying in said plane;

said screen member extends along said plane beyond said outer perimeter of said gasket member.

* * * * *